US009003993B1

(12) United States Patent
Ratigan

(10) Patent No.: US 9,003,993 B1
(45) Date of Patent: Apr. 14, 2015

(54) NAUTICAL LINE PAD AND METHOD

(71) Applicant: Edward Ratigan, Graham, NC (US)

(72) Inventor: Edward Ratigan, Graham, NC (US)

(73) Assignee: Fjord, Inc, Graham, NC (US)

( * ) Notice: Subject to any disclaimer, the term of this patent is extended or adjusted under 35 U.S.C. 154(b) by 105 days.

(21) Appl. No.: 13/655,628

(22) Filed: Oct. 19, 2012

(51) Int. Cl.
*B63B 59/02* (2006.01)
*B63B 21/04* (2006.01)

(52) U.S. Cl.
CPC ..... *B63B 21/04* (2013.01)

(58) Field of Classification Search
CPC .. B63B 59/02; B63B 2059/025; B63B 17/02; B63B 19/02; B63B 17/00; E02B 3/26; E02B 17/0021; E02B 17/0017; E02B 3/068; E02B 3/064; E21B 17/01; E01D 15/24
USPC ..... 114/219, 361; 405/211, 218, 212, 215, 405/219
See application file for complete search history.

(56) References Cited

U.S. PATENT DOCUMENTS 5,518,342 A * 5/1996 Wright et al. ..... 405/211

OTHER PUBLICATIONS

One (1) page printout from the website "Schoonerman.Com" showing the definition of "Baggywrinkle" and sketches of the same, Oct. 9, 2012.
One (1) page printout from the website "boatsafe.files.wordpress.com" showing a picture of nautical lines with baggywrinkles positioned thereon, Oct. 9, 2012.
One (1) page printout from the website "sailfeed.com" showing a picture of nautical lines with baggywrinkles positioned thereon, Oct. 9, 2012.

* cited by examiner

*Primary Examiner* — Lars A Olson
(74) *Attorney, Agent, or Firm* — Blake P. Hurt

(57) ABSTRACT

A pad for protecting nautical sails from the rigging including a material having a soft outer surface and an inner surface with hook and loop material attached to the material. The pad also includes a restraint attached to the inner surface of the material and a strap engaged by the restraint. A method of using the described pad to protect sails and other fabrics is also provided.

13 Claims, 5 Drawing Sheets

NAUTICAL LINE PAD AND METHOD

FIELD OF THE INVENTION

The invention herein pertains to cable covers and particularly pertains to a sheath for protecting sails and other fabrics from repeated contact with nautical cables and lines.

DESCRIPTION OF THE PRIOR ART AND OBJECTIVES OF THE INVENTION

A baggywrinkle is a nautical term often used for a soft covering for rope or cable to reduce sail chafe. Typically made from short pieces of yarn, baggywrinkles have been used for years to protect sails from wearing holes where the sail contacts cable or rope rigging. The baggywrinkle usually has a long, shaggy fringe which, when wound around the offending cable, provides a soft, plush cylinder that substantially reduces wear on the sail fabric.

One problem with the traditional baggywrinkle is that it is fashioned from marline, a light rope formed from two twisted strands, that is no longer in use aboard the vessel. While it is suitable for protecting sails from wear, worn marline may be structurally compromised and deteriorate rapidly from its own contact with the cable. Further, while the conventional baggywrinkle is moderately effective at protecting sails, it is unattractive to affix large, shaggy baggywrinkles to the rigging of large and often expensive yachts. Not only is the conventional baggywrinkle unsightly, it may also carry dirt and other particulates that may soil the deck or hull.

Thus, in view of the problems and disadvantages associated with prior chafe pads, the present invention was conceived and one of its objectives is to provide a baggywrinkle comprising a pad that engages nautical cables or rope and has a soft outer surface to prevent wear on sails.

It is another objective of the present invention to provide a baggywrinkle acting as a protective shroud with an inner surface having hook material attached and an outer surface with corresponding loop material.

It is still another objective of the present invention to provide a baggywrinkle for covering cable with a restraint affixed to the inner surface.

It is yet another objective of the present invention to provide a cable pad with a strap engaged to the restraint.

It is a further objective of the present invention to provide a baggywrinkle with an elastomeric tube defining a slit sized to receive a nautical cable or rope.

It is still a further objective of the present invention to provide a baggywrinkle pad that affixes zip ties to nautical cable encased in tubing.

It is yet a further objective of the present invention to provide a pad acting as a cable shield with a soft outer covering including white lamb's wool.

It is a further objective of the present invention to provide a method for protecting boat sails from cable chafe with a baggywrinkle.

It is still a further objective of the present invention to provide a method of encasing a nautical cable or rope in rubber tubing and attaching white lamb's wool thereto.

It is yet a further objective to use zip ties to attach a soft pad to a nautical line and then engage hook and loop material to secure the pad to the line.

Various other objectives and advantages of the present invention will become apparent to those skilled in the art as a more detailed description is set forth below.

SUMMARY OF THE INVENTION

The aforesaid and other objectives are realized by providing a pad for engaging nautical lines, the pad having a material with a soft outer surface and an inner surface. The pad also includes hook and loop materials attached to the material. The pad further includes a restraint attached to the inner surface with a strap connected to the restraint. Flexible tubing is also included that defines a slit for engaging a nautical line and is engaged by the strap.

A method of enclosing a nautical line to protect sails and other nearby fabric from chaffing is also provided. The method includes the step of providing a pad with a material having a soft outer surface with loop material attached and an inner surface with hook material connected, a restraint attached to the inner surface, a strap affixed to the restraint, and a tube defining slit. The method also includes the steps of inserting the nautical line into the tube, securing the tube with the strap, and enclosing the nautical line with the pad.

DETAILED DESCRIPTION OF THE PREFERRED EMBODIMENT AND OPERATION OF THE INVENTION

Figure 1:
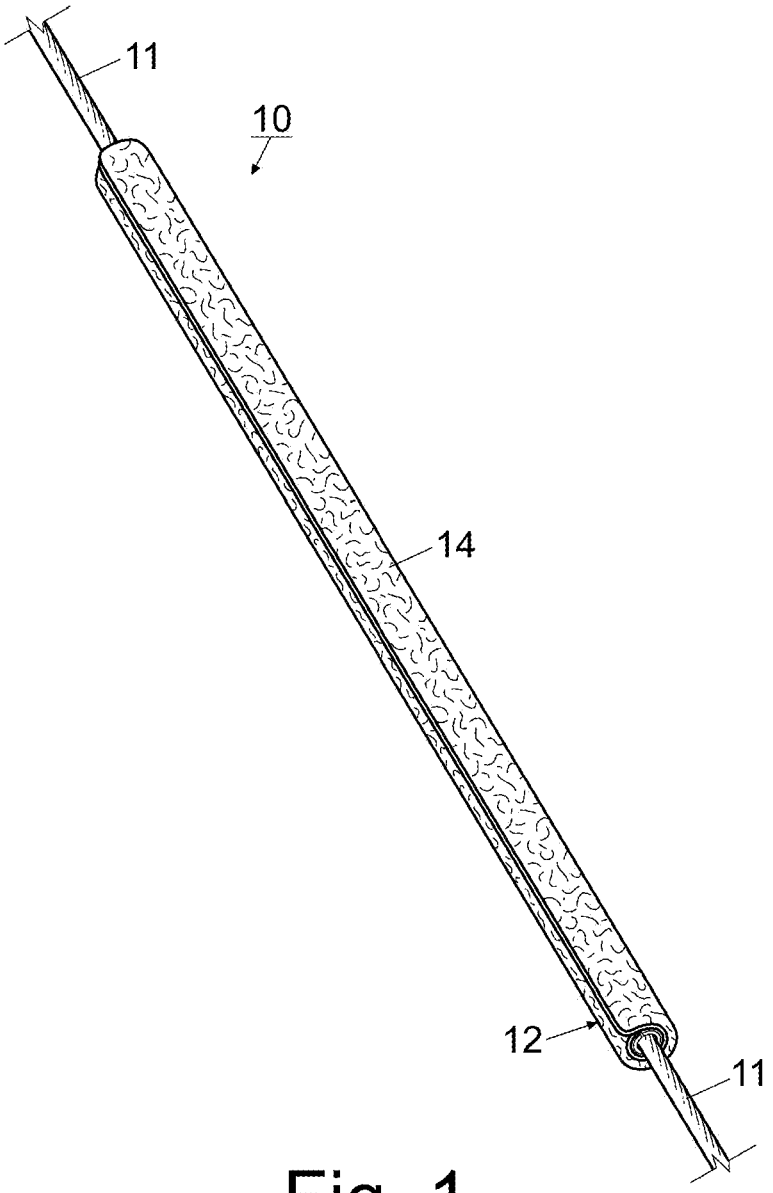
FIG. 1 shows a perspective view of a nautical line chafe pad positioned on a mooring line.
Figure 2:
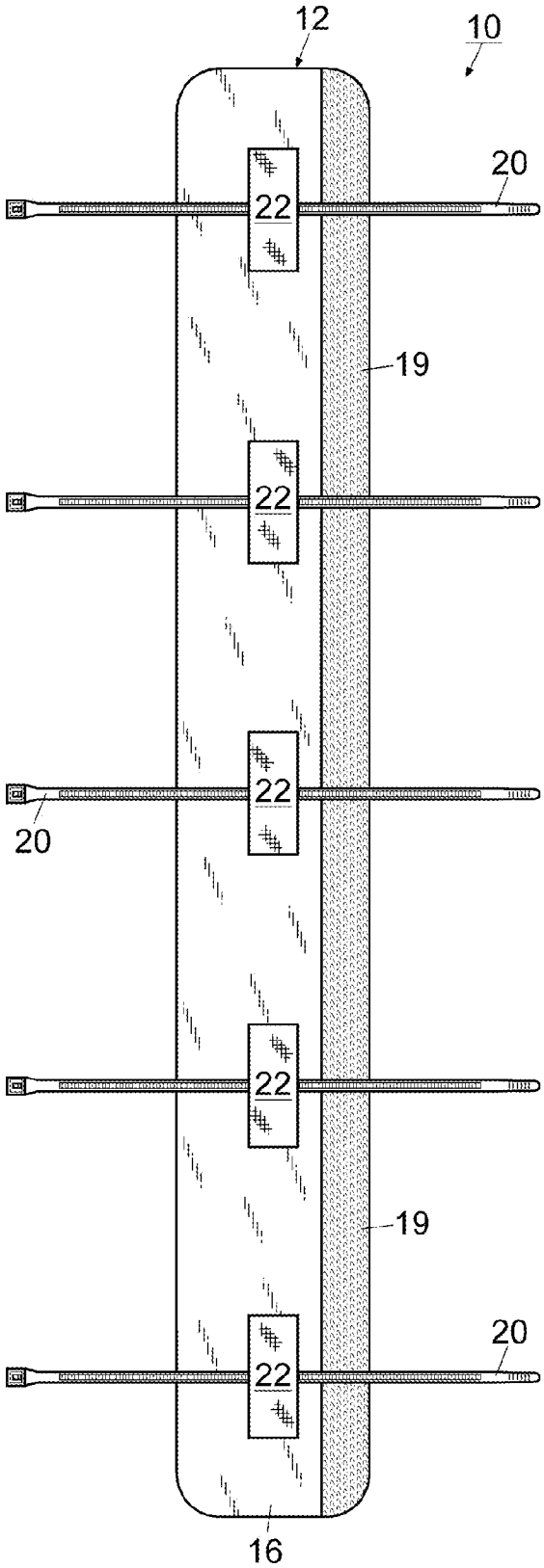
FIG. 2 pictures a rear plan view of the chafe pad of FIG. 1 in an open position.

For a better understanding of the invention and its operation, turning now to the drawings, FIG. 1 shows a perspective view of nautical line chafe pad 10 having material 12 with soft outer surface 14 engaged with conventional nautical line 11. For the purpose of this application, the term nautical line is defined as any material used in the rigging of a nautical vessel, including, but not limited to metal cable and rope. As seen in FIGS. 2-5, preferred pad 10 also includes restraint 22 attached to inner surface 16, strap 20 affixed to restraint 22, and tubing 24 engaged by strap 20. Preferred pad 10 also includes loop material 18 and corresponding hook material 19 affixed to opposing sides of material 12.

In FIG. 1, chafe pad 10 is shown wrapped completely around nautical line 11. Although the greatest sail chaffing occurs when line 11 is a typical steel cable, pad 10 also prevents chaffing from rope and other conventional rigging materials as well. Preferred material 12 is represented in FIGS. 1-5 as a woven polymeric fabric but material 12 could also be formed from metal, fabric, or any other appropriate material.

Figure 3:
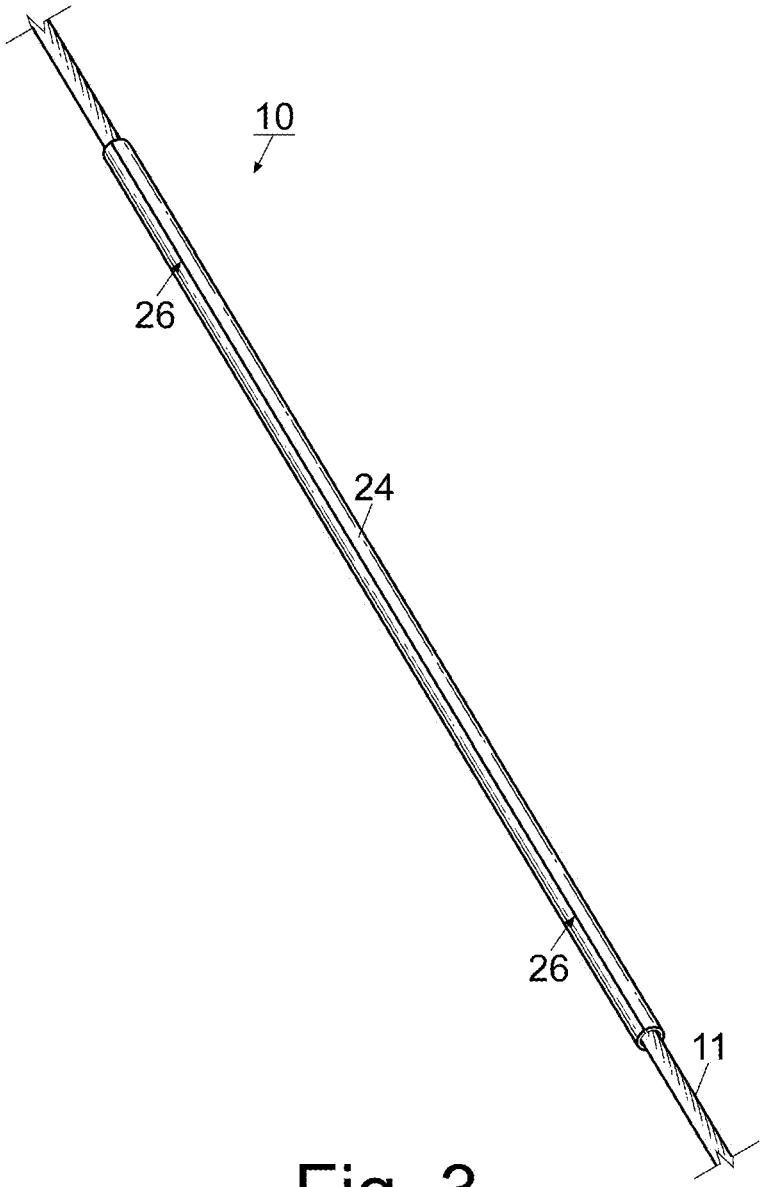
FIG. 3 depicts a perspective view of the nautical line of FIG. 1 encased in tubing.
Figure 4A:
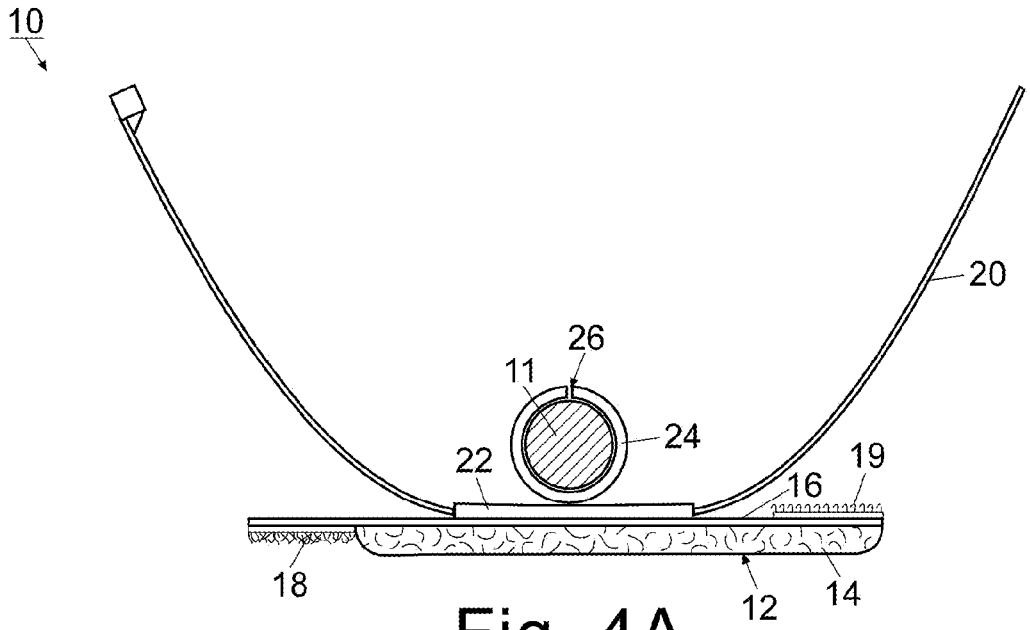
FIG. 4A demonstrates an elevated side view of the chafe pad of FIG. 2 prior to encasing the nautical line.
Figure 4B:
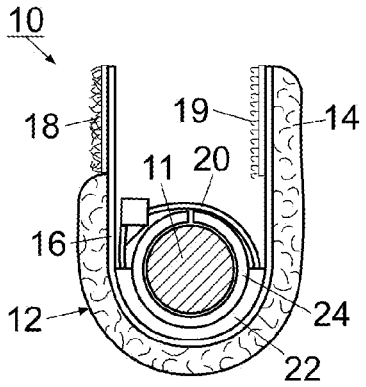
FIG. 4B illustrates an elevated side view of the chafe pad of FIG. 4A with a strap engaged.

In use, nautical line 11 would be encased in tubing 24 as shown in FIG. 3 by manually opening slit 26 to deform tubing 24 for inserting line 11 therein whereby tubing 24 would wrap around line 11 upon release of slit 26. After encasing with tubing 24, line 11 would be positioned down the longitudinal axis of pad 10 as seen in FIG. 4A, straps 20 placed around line 11 and fastened tight as seen in FIG. 4B. Preferably, strap 20 is a conventional uni-directional plastic zip tie but any member that is capable of securing line 11 encased in tubing 24 to pad 10 such as a rachet, clamp, or cleat would also suffice.

Figure 4C:
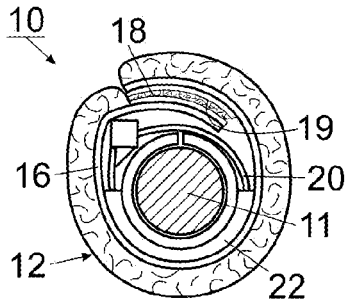
FIG. 4C features an elevated side view of the chafe pad of FIG. 4B with hook and loop materials engaged.

After line 11 is secured with strap 20, loop material 18 is manually engaged to hook material 19 (see FIG. 4C).

Soft outer material 14 may be formed with any material that reduces chaffing from nautical line 11 but lamb's wool is preferred. The previously described engagement provides a continuous surface of soft outer material 14. Further, although any lamb's wool will reduce chaffing, white lamb's wool is preferred because there are no dyes included which have a propensity to "bleed" when wet and discolor expensive boat surfaces.

FIG. 3 depicts a perspective view of nautical line 11 encased in tubing 24. Preferred tubing 24 is a flexible elastomeric polymer tubing capable of engaging line 11 without tearing or cracking for an extended period of time. Preferred tubing 24 also has slit 26 extending the longitudinal length of tubing 24. Slit 26 allows line 11 to be quickly and easily positioned within tubing without additional tools or substantial nautical knowledge. Without tubing 24, pad 10 slides up and down line 11 and does not remain firmly in place to protect nearby fabric from chaffing.

FIGS. 4A, 4B, and 4C demonstrate an elevated side view of the components of chafe pad 10 in various stages of engagement. Strap 20 passes through and engages restraint 22 which is affixed to inner surface 16 of pad 10. Restraint 22 may be adhesively attached or formed integrally with inner surface 16, but preferred restraint 22 is sewn to inner surface 16. FIG. 4B illustrates chafe pad 10 of FIG. 4A with strap 20 engaged to line 11 and tubing 24. In this configuration, pad 10 is securely attached to line 11 but a substantial gap exists between the two outer covering sides 14. Without curling material 12 over upon itself as featured in FIG. 4C, line 11 and tubing 24 remain exposed to the elements. Prolonged friction between tubing 24 and nearby fabric, for example a sail during high winds (not shown) could create substantial friction and heat that could damage 24 and expose line 11 for additional chaffing. In this configuration, line 11 is securely confined within tubing 24 via strap 20 and removed from potential exposure. Loop material 18 is positioned beneath and engaged with hook material 19, making it highly unlikely that pad 10 will displace due to physical forces such as wind or rain. Further, soft outer surface 14 and loop material 18 are the only surfaces that are exposed to nearby fabric such as a sail, and either surface is much less abrasive and less lively to cause chaffing damage than nautical line 11. Loop material 18 and corresponding hook material 19 are displayed in FIGS. 4A-C in only one cooperative position but it should be understood that their respective positions could be reversed or inverted while maintaining the functionality of chafe pad 10.

Figure 5:
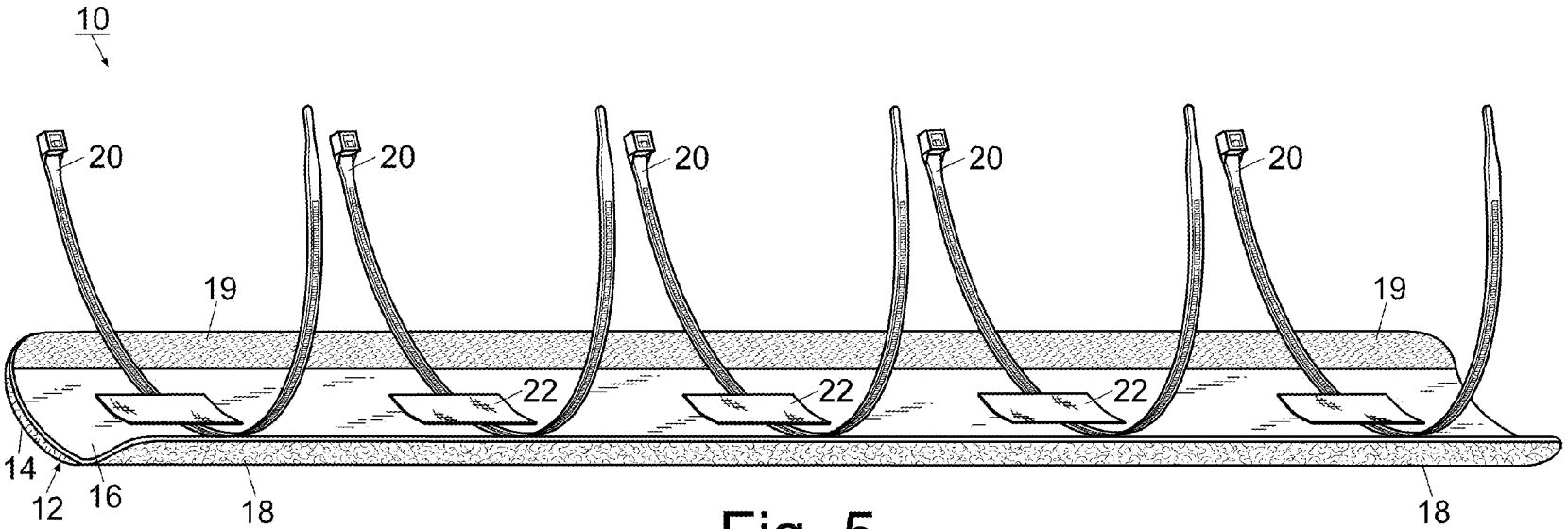
FIG. 5 shows a perspective rear view of the chafe pad of FIG. 2.

FIG. 5 shows a perspective rear view of the chafe pad 10 when not engaged with nautical line 11. When not in use, chafe pad 10 is generally flat unless the materials that make up material 12 have a slight memory and retain a slightly cylindrical shape. This makes storing pad 10 relatively easy because several pads may be stacked on one another when straps 20 are removed from restraints 22. This is particularly important on boats where storage space is critical, especially for long journeys.

A method of enclosing a nautical line to protect sails and other nearby fabric from chaffing is also provided. The method includes the step of providing pad 10 with material 12 having soft outer surface 14 with loop material 18 attached and inner surface 16 with hook material 19 connected, restraint 22 attached to inner surface 16, strap 20 affixed to restraint 22, and tube 24 defining slit 26. The method also includes the steps of inserting nautical line 11 into tube 24, securing tube 24 strap 20, and enclosing nautical line 11 with pad 10. The preferred method further includes providing loop material 18 and hook material 19 the longitudinal length of pad 10, tightening straps 20 around tube 24 to prevent displacement of pad 10, and providing outer surface 14 of white lamb's wool. The preferred method also includes the steps of wrapping pad 10 around nautical line 11 and affixing loop material 18 to hook material 19.

The illustrations and examples provided herein are for explanatory purposes and are not intended to limit the scope of the appended claims.

I claim:

1. A pad for engaging nautical lines comprising: a fabric with an outer surface and an inner surface, a hook material, and loop material, said hook and loop materials attached to said fabric, a tube defining a slit, a strap holding said tube, a restraint, said restraint attached to said inner surface, and said strap engaged by said restraint.

2. The pad of claim 1 wherein said tube comprises an elastomeric material.

3. The pad of claim 1 wherein said tube extends the length of said pad.

4. The pad of claim 1 wherein said tube encloses a nautical line.

5. The pad of claim 1 wherein said fabric outer surface is formed from lamb's wool.

6. The pad of claim 5 wherein said lamb's wool is white.

7. The pad of claim 4 wherein said strap is a zip tie.

8. A pad for engaging nautical lines comprising: a non-marking fabric with an outer surface of lamb's wool and an inner surface, a strip of hook material, said strip of hook material attached to said inner surface, a strip of loop material, said strip of loop material attached to said outer surface, a zip tie, a restraint, said restraint attached to said inner surface, and said zip tie engaged by said restraint, an elastomeric tube, said tube defining a slit, said tube held by said zip tie, and said tube extending the length of said pad whereby engaging nautical lines with said pad reduces sail chafe.

9. A method of enclosing a nautical line comprising the steps of:

a) providing a pad comprising a fabric having an outer surface with loop material attached and an inner surface with hook material connected, a restraint attached to the inner surface, a strap affixed to the restraint, and a tube defining a slit;

b) inserting the nautical line into the tube;

c) securing the tube with the strap; and d) enclosing the nautical line in the pad.

10. The method of claim 9 wherein the step of providing a hook and loop materials further comprises the step of providing a strip of hook and loop materials the longitudinal length of the pad.

11. The method of claim 10 wherein the step of securing the tube further comprises the step of tightening the straps around the tube to prevent displacement of the pad.

12. The method of claim 11 wherein enclosing the nautical line with the pad further includes the steps of:

a) wrapping the pad around the nautical line, and b) affixing the hook material to the loop material.

13. The method of claim 12 wherein the step of providing a fabric with an outer surface further comprises providing an outer surface formed of white lamb's wool.

* * * * *